United States Patent [19]

Noda

[11] Patent Number: 4,545,212

[45] Date of Patent: Oct. 8, 1985

[54] SUPER-HEAT DETECTOR FOR REFRIGERATING APPARATUS

[75] Inventor: Sadafumi Noda, Isahaya, Japan

[73] Assignee: Mitsubishi Denki Kabushiki Kaisha, Tokyo, Japan

[21] Appl. No.: 635,270

[22] Filed: Jul. 27, 1984

[30] Foreign Application Priority Data

Jul. 29, 1983 [JP] Japan ..... 58-140299

[51] Int. Cl.[4] ..... F25B 41/00

[52] U.S. Cl. ..... 62/129; 62/212; 62/225; 374/143

[58] Field of Search ..... 236/56, 59; 62/125, 62/129, 209, 212, 225; 374/143

[56] References Cited

U.S. PATENT DOCUMENTS 4,197,990 4/1980 Carberg et al. ..... 236/56 X

FOREIGN PATENT DOCUMENTS 57-17040 1/1982 Japan .

*Primary Examiner*—William E. Wayner

*Attorney, Agent, or Firm*—Oblon, Fisher, Spivak, McClelland & Maier

[57] ABSTRACT

A super-heat detector of refrigerant gas comprises a semiconductor pressure sensor for detecting a pressure of the refrigerant gas in a refrigerating apparatus, a semiconductor temperature sensor for detecting a temperature of said refrigerant gas, and an operational controller which converts an output signal from said semiconductor pressure sensor to a value corresponding to a saturation temperature of said refrigerant gas pressure, and produces an output electrical signal corresponding to super-heat condition of said refrigerant gas by comparison between said corresponding value of the saturation temperature and said output from said semiconductor temperature sensor.

3 Claims, 2 Drawing Figures

SUPER-HEAT DETECTOR FOR REFRIGERATING APPARATUS

BACKGROUND OF THE INVENTION

1. Field of the Invention

This invention relates to a detector, and, more particularly, it is concerned with a super-heat detector of a refrigerating apparatus, which detects super-heat condition of refrigerant gas flowing in a refrigerant circuit in the refrigerating apparatus.

2. Description of the Prior Art

In general, when liquid refrigerant is mixed into a conduit run within a refrigerant circuit of the refrigerating apparatus, such as, for example, into gaseous refrigerant flowing in the intake tube of a compressor, the compressor brings about liquid compression to possibly cause mechanical damage to the compressor. In order to avoid such mechanical breakage of the compressor, it is necessary to detect super-heat condition of the refrigerant gas flowing in the intake tube of the compressor so as to control or protect it against or from sucking the liquid refrigerant into it.

As the device for detecting super-heat condition of the refrigerant gas, there has so far been known one as shown in FIG. 1 of the accompanying drawing. In FIG. 1, a reference numeral 1 designates an arbitrary conduit run constituting the refrigerant circuit of the refrigerator, a numeral 2 refers to a refrigerant gas flowing in and through the conduit run, and a reference numeral 3 denotes a main body of the detector to detect super-heat condition of the refrigerant gas. A saturation pressure of the refrigerant gas is fed to the detector main body 3 through a tube 4.

A temperature of the refrigerant gas in the conduit run 1 is detected by a temperature sensing element (cylinder) 5. The interior of the temperature sensing element 5 is filled with a substance 5*a* which thermally expands or contracts in response to temperature of the refrigerant gas. A pressure to be exerted by expansion and contraction of this filling substance 5*a* is transmitted to the detector main body 3 through a capillary tube 6.

A diaphragm 7 is provided in the detector main body 3. This diaphragm 7 is subjected to deformation in accordance with a difference in pressure transmitted through the capillary tube 6 and the tube 4.

A switch contact 8 is attached to this diaphragm 7. In confrontation to this switch contact 8, a counterpart switch contact 9 is provided in the detector main body 3. Both switch contacts 8 and 9 constitute a pair so as to perform opening and closing (on-off) operations of the switch. The opening and closing operations of the switch are taken out of an electrical circuit 10 in the form of electrical signals.

In the following, operation of the conventional super-heat detector will be explained. The detector main body 3 receives, in a space 3*a* below the diaphragm 7, a saturation pressure $P_1$ of the refrigerant gas 2 within the conduit run 1. On the other hand, the filling substance 5*a* within the temperature sensing element 5 senses the temperature of the refrigerant gas 2 to expand (or contract), and generates a pressure $P_2$ matched with the temperature which it has sensed out. Through the capillary tube 6, the pressure $P_2$ acts in a space 3*b* above the diaphragm 7.

As the result of this, the diaphragm 7 will be displaced to either upper or lower direction by the differential pressure of ($P_2$- $P_1$). Therefore, by appropriate selection of the thermal expansion coefficient of the filling substance 5*a* in the temperature sensing element 5, it becomes possible to perform on-off operations between the switch contacts 8 and 9 when the refrigerant gas has reached a predetermined super-heat condition.

In this manner, the refrigerator can be controlled against, or prevented from, the damage by detection of the super-heat condition of the refrigerant gas flowing in and through the refrigerant circuit. Incidentally, use of bellows in place of the diaphragm 7 can also produce the same effect as mentioned above.

Since the conventional super-heat detector is constructed as mentioned above, there have been such disadvantages that the heat capacity of the temperature sensing element 5 is large, on account of which its temperature response is slow, and that, since the switch contacts 8 and 9 are of a mechanical type, the switch is difficult to find its use for any purposes other than the on-and-off control operations.

SUMMARY OF THE INVENTION

The present invention has been made with a view to removing the defects in the conventional mechanical type super-heat detector as described in the foregoing.

It is therefore an object of the present invention to provide a super-heat detector for a refrigerating apparatus, which is capable of detecting super-heat condition of the refrigerant gas flowing in and through the conduit run in utilization of a semiconductor pressure sensor and a semiconductor temperature sensor.

According to the present invention in general aspect of it, there is provided a super-heat detector of refrigerant gas, which comprises: (a) a semiconductor pressure sensor for detecting a pressure of the refrigerant gas in a refrigerating apparatus; (b) a semiconductor temperature sensor for detecting a temperature of said refrigerant gas; and (c) an operational controller which converts an output signal from said semiconductor pressure sensor to a value corresponding to a saturation temperature of said refrigerant gas pressure, and produces an output electrical signal corresponding to super-heat of said refrigerant gas by comparison between said corresponding value of the saturation temperature and said output from said semiconductor temperature sensor.

BRIEF DESCRIPTION OF DRAWING

The foregoing object, still other objects as well as advantages and features of the present invention will become more apparent and understandable from consideration of the following detailed description of a preferred embodiment thereof, especially when taken in conjunction with the accompanying drawings.

In the drawing.

DETAILED DESCRIPTION OF THE PREFERRED EMBODIMENTS

In the following, the super-heat detector for a refrigerating apparatus according to the present invention will be explained in reference to the accompanying drawing illustrating one preferred embodiment thereof.

Figure 1:
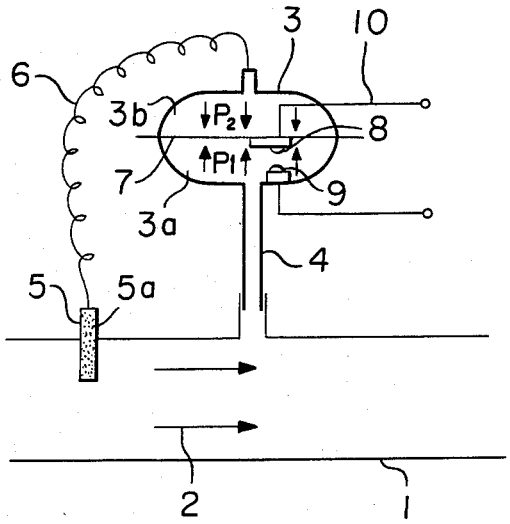
FIG. 1 is a schematic block diagram showing a construction of a conventional super-heat detector.
Figure 2:
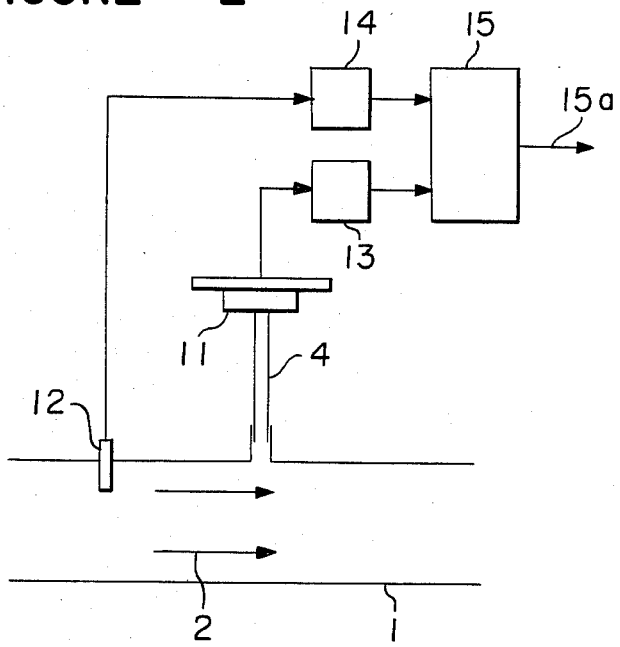
FIG. 2 is a schematic block diagram showing a construction of the super-heat detector of a refrigerating apparatus according to one preferred embodiment of the present invention.

Referring to FIG. 2 which is a schematic block diagram showing a construction of one embodiment of the super-heat detector according to the present invention, those parts which are identical with, or similar to, those in FIG. 1 are designated by the same reference numerals.

In FIG. 2, the refrigerant gas 2 is caused to flow in and through the conduit run 1 in the direction shown by arrow marks. A pressure of this refrigerant gas is detected by a semiconductor pressure sensor 11 through the tube 4 and the detected pressure is converted into an electric signal by the pressure sensor 11. On the other hand, a temperature of the refrigerant gas 2 is detected by a semiconductor temperature sensor 12 which is fitted to the conduit run 1 and extends inside thereof, the detected temperature being converted into an electric signal. An output from the semiconductor temperature sensor 12 is forwarded to an operational controller 15 through an amplifier 14, and an output from the semiconductor pressure sensor 11 is forwarded to the operational controller 15 through an amplifier 13.

The operational controller 15 takes thereinto the output signals from the amplifier 13 and 14, performs the operational processing, and produces an output electrical signal 15*a* corresponding to the super-heat condition.

In the following, explanations will be given as to the operations of the super-heat detector for the refrigerating apparatus according to the present invention.

The pressure of the refrigerant gas 2 in the refrigerant conduit run 1 is detected by the semiconductor pressure sensor 11 through the tube 4, and the output from this semiconductor pressure sensor 11 is amplified by the amplifier 13, after which it is introduced as an input into the operational controller 15.

The operational controller 15 converts the input electrical signal thereinto in accordance with a characteristic equation of pressure versus saturation temperature of the refrigerant (in the case of, for example, "Furon 22" gas, the saturation temperature t, under the pressure P of from 0.1 to 5.0 kg/cm$^2$, is represented by $t=-66.5974+31.6982P-7.54026P^2+1.08836P^3-6.38452\times10^{-2}P^4$).

On the other hand, the temperature of the refrigerant gas is detected by the semiconductor temperature sensor 12 and introduced as an input into the operational controller 15 through the amplifier 14.

The electrical signal corresponding to the saturation temperature as has been converted from the pressure of the gas and the electrical signal corresponding to the substantive temperature of the refrigerant gas are compared by a comparison circuit within the operational controller 15, and an output signal 15*a* is produced from it.

When this output is used as a super-heat switch for the protective device, it may be compared with an electrical input of a level corresponding to a preset super-heat value, and then be taken out as an on-off signal.

On the other hand, when the output is used as a control signal for controlling the super-heat, an analog signal output is taken out of the operational controller 15, and then transmitted to a control medium (an actuator).

For the semiconductor pressure sensor 11, there may be used one such as, for example, a silicon diaphragm as an elastic deformable body, over which a semiconductor strain gauge is provided by spreading.

As stated in the foregoing, since the super-heat detector for the refrigerator according to the present invention uses semiconductor sensors for detection of pressure and temperature, it has excellent responsiveness, hence it can be utilized as a control device as well as a protective device.

Although the present invention has been described in the foregoing with reference to a particular embodiment thereof, it should be understood that the present invention is not restricted by this embodiment alone, but any changes and modifications may be made by those persons skilled in the art within the spirit and scope of the invention as recited in the appended claim.

What is claimed is:

1. A super-heat detector of refrigerant gas, which comprises:

(a) a semiconductor pressure sensor for detecting a pressure of the refrigerant gas in a conduit run for passing said refrigerant gas wherein said semiconductor pressure sensor is fitted to said conduit;

(b) a semiconductor temperature sensor for detecting a temperature of said refrigerant gas wherein said temperature sensor is fitted to said conduit and wherein said temperature sensor outputs an electrical signal; and (c) an operational controller having one input for receiving the output of said temperature sensor and a second input for receiving the output of said pressure sensor wherein said controller converts an output signal from said semiconductor pressure sensor to a value corresponding to a saturation temperature of said refrigerant gas pressure, and produces an output signal corresponding to super-heat condition of said refrigerant gas by comparison between said corresponding value of the saturation temperature and said output from said semiconductor temperature sensor.

2. The super-heat detector of refrigerant gas according to claim 1, wherein said semiconductor pressure sensor detects a pressure of the refrigerant gas through a tube 4.

3. The super-heat detector of refrigerant gas according to claim 1, wherein electric signals from said semiconductor temperature sensor and said semiconductor pressure sensor are respectively fed to said operational controller through amplifiers.

* * * * *